United States Patent [19]

Griffin

[11] 4,043,408

[45] Aug. 23, 1977

[54] APPARATUS FOR REMOVING CONCRETE AROUND EXPOSED REINFORCING ROD

[76] Inventor: William Dale Griffin, 3601 Jefferson Ave., Texarkana, Arkansas 75501

[22] Filed: June 18, 1976

[21] Appl. No.: 697,694

[52] U.S. Cl. ..... 175/416; 175/398; 175/262

[51] Int. Cl.[2] ..... E21C 13/06

[58] Field of Search ..... 125/20; 175/91, 262, 398, 175/399, 400, 405, 416

[56] References Cited

U. S. PATENT DOCUMENTS

| | | | |
|---|---|---|---|
| 3,910,361 | 10/1975 | Hasewend | 175/262 X |
| 1,176,884 | 3/1916 | Davidson | 175/398 |
| 278,517 | 5/1883 | Derby | 175/405 |
| 905,440 | 12/1908 | Layne | 175/262 X |
| 2,209,619 | 7/1940 | Wilcox | 175/398 X |
| 2,305,200 | 12/1942 | Sitton | 175/398 X |

*Primary Examiner*—Ernest R. Purser
*Assistant Examiner*—Richard E. Favreau
*Attorney, Agent or Firm*—Frank P. Presta

[57] ABSTRACT

This invention provides for an improved apparatus for removing the concrete around and exposed reinforcing rod in cast concrete so that the rod may be cut off. The apparatus comprises an impact-operated rock drill with a central passage fitting around the reinforcing rod.

2 Claims, 5 Drawing Figures

APPARATUS FOR REMOVING CONCRETE AROUND EXPOSED REINFORCING ROD

BACKGROUND OF THE INVENTION

In construction operations, reinforcing rod is often left protruding from concrete for various reasons in both precast or cast-in-place concrete construction. It is good construction practice to later cut off this exposed rod below the finished surface of the concrete and fill the hole with patching material to prevent future rusting of the rod with its resultant staining and possible spalling of the concrete. Usual methods involve chipping out the concrete around the exposed rod either by hand or mechanically operated chisels, which results in a large irregular hole of uncertain depth and resulting chips which may injure the operator. In addition, striking the reinforcing rod with the chisel may cause loosening of the rod within the concrete or undetected cracks in the concrete resulting in future problems of weakened construction or water seepage.

SUMMARY OF THE INVENTION

The present apparatus comprises a rock drill bit having a central passage through the bit and attached shaft which will fit around the exposed reinforcing rod. The drill bit is provided with depth reference markings to enable the hole to be drilled accurately to the prescribed distance below the finished surface.

The drill bit and shaft are slid over the exposed reinforcing rod and, using the reinforcing rod as a guide, a recessed hole of regular dimensions may be cut around the rod allowing it to be easily cut off at the prescribed depth below the surface. Advantages of this apparatus include a time savings in cutting the hole, uniform depth of the holes following prescribed specifications, greater safety for the operator, time and material savings in filling the hole flush with the surrounding surface, and no inadvertent lateral striking of the reinforcing rod which could damage the finished job.

DESCRIPTION OF THE PREFERRED EMBODIMENTS

Figure 1:
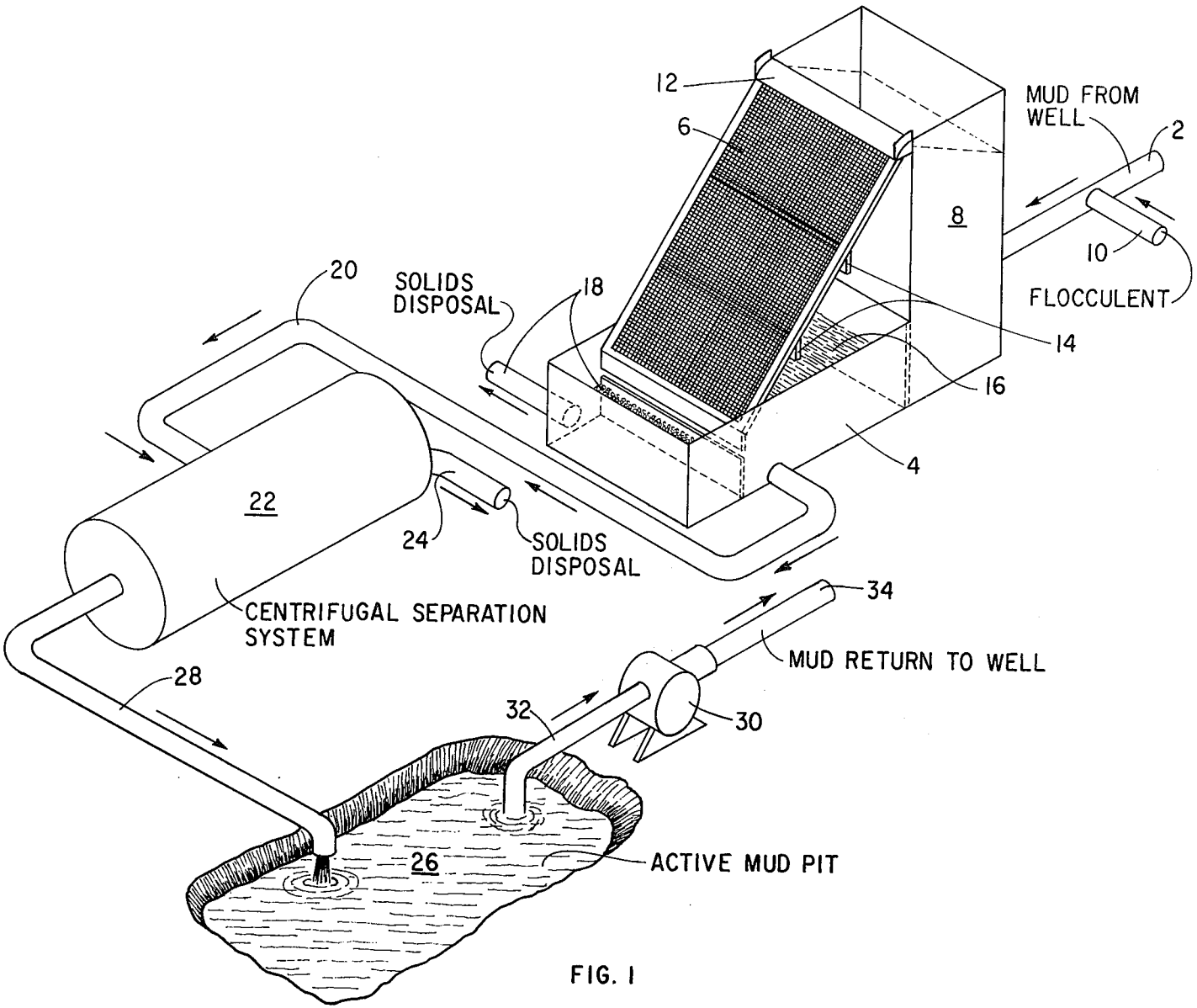
FIG. 1 is an elevational view, partly in section, of the apparatus of the present invention.

As shown in FIG 1, a drill shaft 10 is provided with a central hollow core 12 of sufficient diameter to slidably pass over the reinforcing rod 14 that is to be cut. The drill shaft 10 is provided with one end 16 suitably formed for connection to or use with either a mechanical or hand hammer (not shown). The opposite end 18 of the drill shaft 10 is provided with screw threads or other suitable means for attachment to the cutting head 20.

Figure 2:
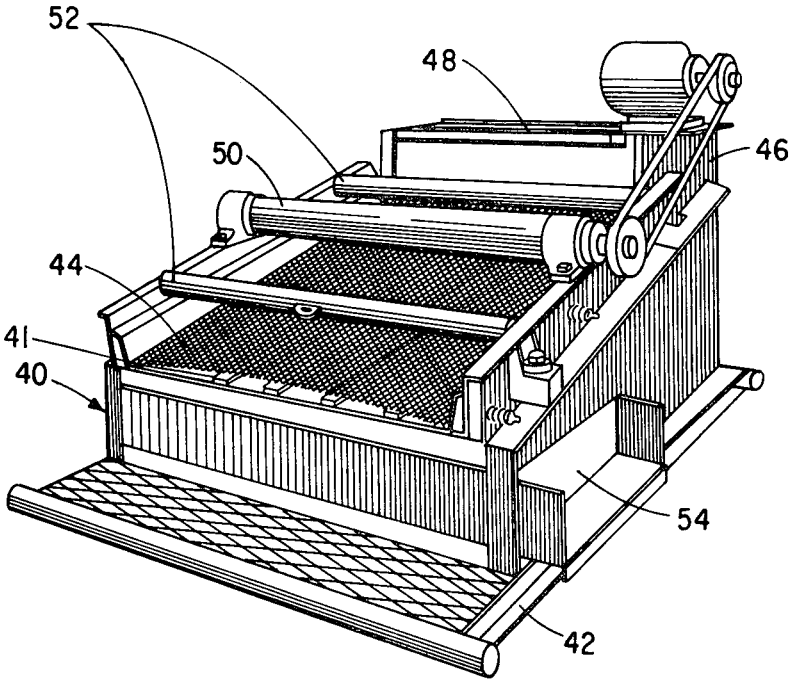
FIG. 2 is a bottom plan view of the cutting head of the apparatus of the present invention.

The cutting head 20 is provided with screw threads 22 or other suitable means to secure it to the drill shaft 10, and is provided with a hollow central core 24 of sufficient diameter to slidably pass over the reinforcing rod 14 that is to be cut. As shown in FIG. 2, the cutting head 20 is provided with cutting teeth 26 radially arranged around the hollow core 24 which are of a shape and hardness well known in the art as suitable for cutting through concrete. The cutting head 10 is preferably suitably relieved as at 28 (FIG. 3) so that contact with the hole being cut is limited to the cutting teeth 26.

Figure 3:
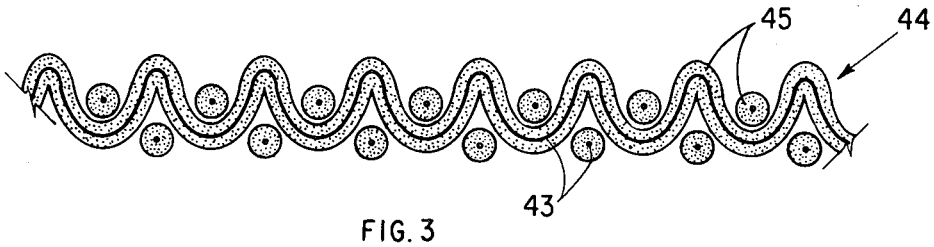
FIG. 3 is an enlarged, partial elevational view, partly in section, of the lower portion of the drill shaft and the cutting head of a second embodiment of the present apparatus.
Figure 4:
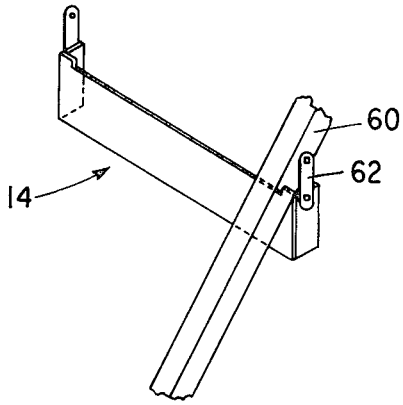
FIG. 4 is a top plan view, partly in section, of a portion of the apparatus shown in FIG. 3.
Figure 1:
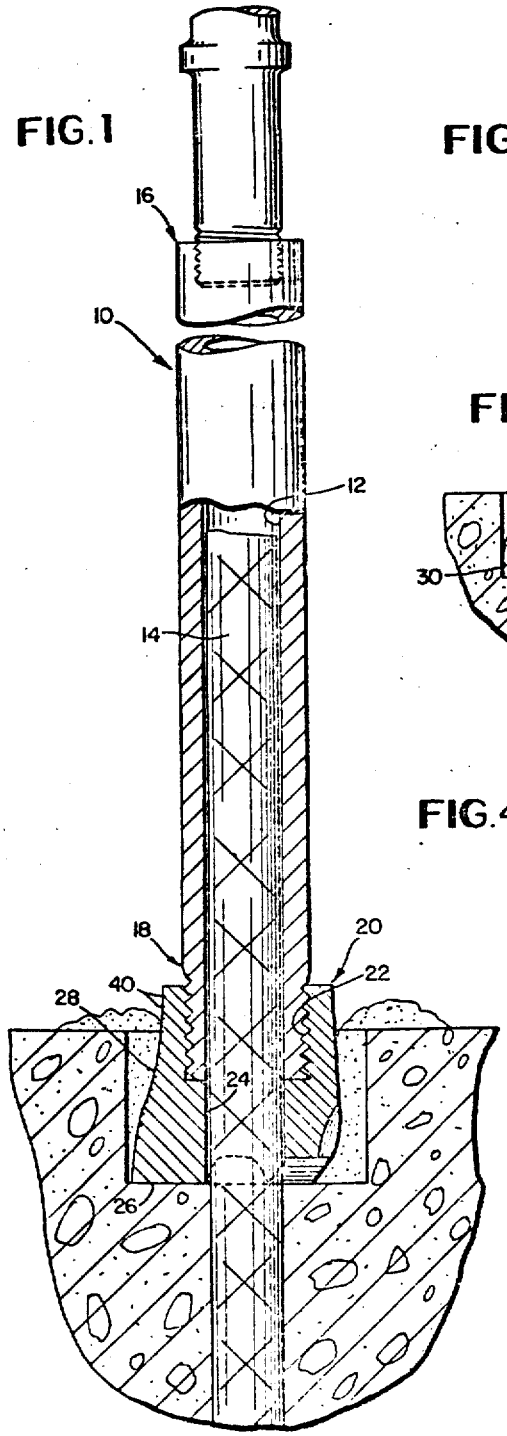
Figure 2:
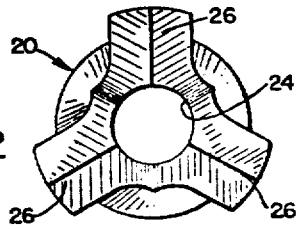
Figure 3:
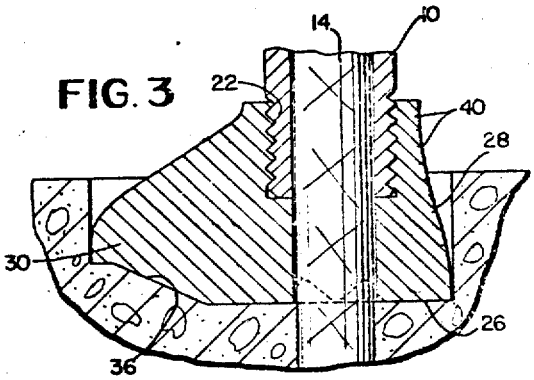
Figure 4:
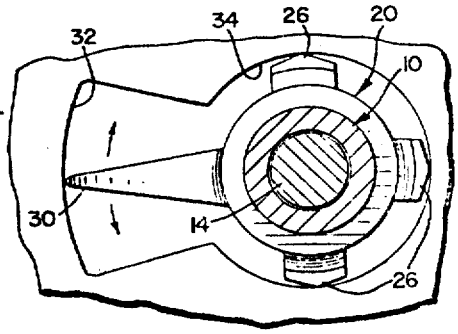
Figure 5:
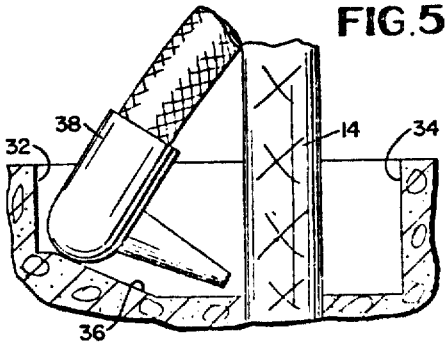
FIG. 5 is an elevational view showing the step of the cutting of the reinforcing rod after removal of the present apparatus from the hole formed in the concrete.

In a preferred embodiment, one of the cutting teeth 30 is formed as illustrated in FIGS. 3 and 4 so that a section 32 of the circumference of the finished hole 34 is enlarged and formed at an angle 36 (FIG. 5), providing for ready placement of a cutting torch 38 or other suitable means for cutting the reinforcing rod 14.

Also, in a preferred embodiment, the cutting head 20 is provided with depth markings 40 (FIG. 1) suitably inscribed on the exterior surface so that correct hole depth may be easily determined.

In operation, a protruding reinforcing rod 14 that is to be cut off below the finished surface of the concrete 15 is first cut off, if necessary, at a suitable distance from the concrete surface so that the cutting head 20 attached to the drill shaft 10 may be conveniently positioned around the reinforcing rod 14.

A hammer or mechanical hammer (not shown) is utilized to operate the drill shaft 10 and cutting head 20 to cut a relief area around the reinforcing rod 14, using the reinforcing rod 14 as the drill guide. In a preferred method, the drill shaft and cutting head are rotated back and forth over only a sufficient arc such that the teeth 26 overlap in their cutting area and the enlarged tooth 30 cuts out a larger relieved area 32 around one side of the reinforcing rod 14.

After the prescribed depth of cut is reached, as indicated by the depth markings 40, the cutting head 20 and shaft 10 are removed from their position around the reinforcing rod 14.

Thereafter, a standard cutting torch 38 or other suitable means is positioned near the bottom 36 of the enlarged area 32 of the hole 34 which is formed by the enlarged cutting tooth 30. This places the cutting torch 38 in the proper position to easily cut through the reinforcing rod 14 without applying intensive heat on the surrounding concrete which could cause it to chip and spall.

What is claimed is:

1. Apparatus for removing concrete around the exposed portion of a reinforcing rod or the like, said apparatus comprising:

an elongated drill shaft having a central opening adapted to be slidably positioned over the exposed portion of the rod, a cutting head having a plurality of substantially radially outwardly extending teeth secured to the leading end of said drill shaft and adapted to surround the inner end of the exposed portion of the rod to remove the concrete surrounding said rod when said drill shaft is moved on said rod in a predetermined manner, and one of said teeth extending outwardly a greater distance than the other teeth to cut an enlarged section in the concrete when said drill shaft is moved in a predetermined manner for accommodating a means for cutting the exposed portion of the rod beneath the surface of the concrete.

2. The apparatus of claim 1 wherein the upper portion of said cutting head is relieved inwardly to facilitate its movement in the concrete being cut thereby.

* * * * *

UNITED STATES PATENT OFFICE

CERTIFICATE OF CORRECTION

Patent No. 4,043,408 Dated August 23, 1977

Inventor(s) William Dale Griffin

It is certified that error appears in the above-identified patent and that said Letters Patent are hereby corrected as shown below:

On the cover sheet and sheets 1 and 2 of the drawings should be canceled and substituted with the correct drawing figures as shown on the attached sheets.

Signed and Sealed this

*Twenty-fourth* Day of *January 1978*

[SEAL]

*Attest:*

RUTH C. MASON
*Attesting Officer*

LUTRELLE F. PARKER
*Acting Commissioner of Patents and Trademarks*

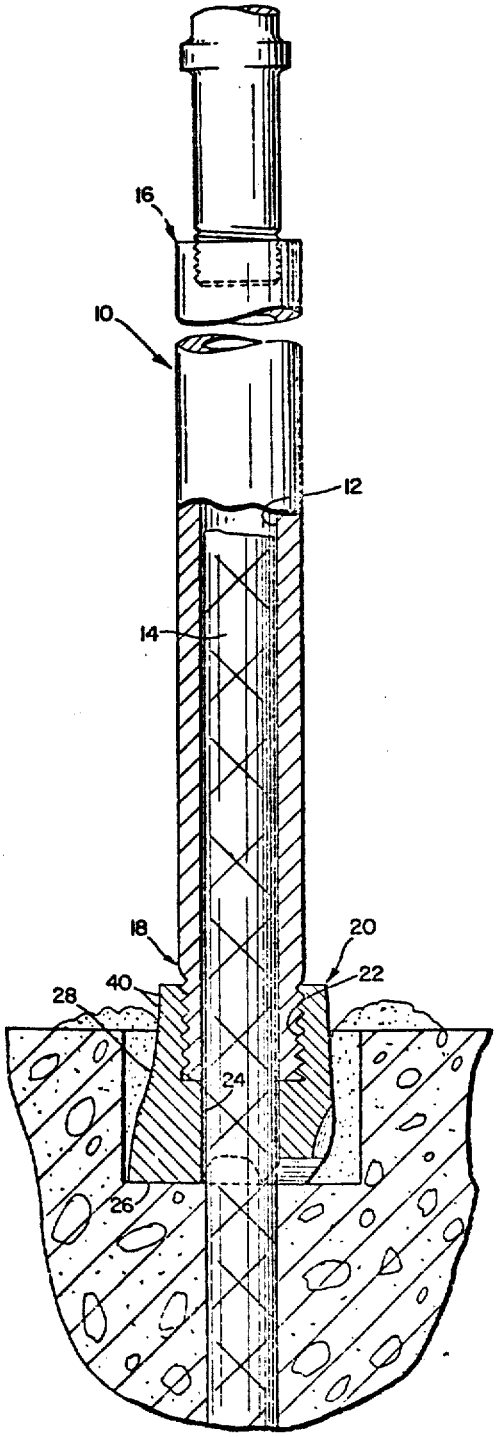
16
10
12
14
18
20
22
40
28
24
26